US006832644B2

(12) United States Patent
Stauder et al.

(10) Patent No.: US 6,832,644 B2
(45) Date of Patent: Dec. 21, 2004

(54) COOLING MODULE WITH AIR DAMS

(75) Inventors: Frank A. Stauder, London (CA); Alexander Graham Hunt, London (CA)

(73) Assignee: Siemens VDO Automotive Inc., Mississauga (CA)

( * ) Notice: Subject to any disclaimer, the term of this patent is extended or adjusted under 35 U.S.C. 154(b) by 213 days.

(21) Appl. No.: 09/956,658

(22) Filed: Sep. 20, 2001

(65) Prior Publication Data

US 2003/0019606 A1 Jan. 30, 2003

Related U.S. Application Data

(60) Provisional application No. 60/299,703, filed on Jun. 20, 2001.

(51) Int. Cl.[7] ..... F01P 11/10; F01P 7/10; F01P 5/06

(52) U.S. Cl. ..... 165/41; 165/51; 165/286; 165/121; 165/122; 123/41.49; 123/41.04; 180/68.1; 180/68.4

(58) Field of Search ..... 165/41, 51, 121, 165/122, 286; 123/41.04, 41.49; 180/68.1, 68.4; 415/146

(56) References Cited

U.S. PATENT DOCUMENTS 4,979,584 A * 12/1990 Charles ..... 180/68.1
6,106,228 A * 8/2000 Bartlett ..... 123/41.49

FOREIGN PATENT DOCUMENTS

| | | | |
|---|---|---|---|
| JP | 52-74734 | * | 6/1977 |
| JP | 56-60818 | * | 5/1981 |
| JP | 57-173519 | * | 10/1982 |
| JP | 58-73431 | * | 5/1983 |
| JP | 8-260962 | * | 3/1995 |
| JP | 9-144540 | * | 6/1997 |
| JP | 11-115806 | * | 4/1999 |
| JP | 2000-84926 | * | 3/2000 |
| JP | 2001-132453 | * | 5/2001 |

* cited by examiner

*Primary Examiner*—John K. Ford

(57) ABSTRACT

An engine cooling module 10 which includes a shroud 12, a heat exchanger 18, a fan 14, a motor 13 for driving fan 14, and a plurality of air dams 1. Shroud 12, circumscribing the fan, has a main opening to allow air to pass through the fan to or from a heat exchanger 18. Fan 14 is associated with the shroud 12 to be adjacent to the fan opening to permit air moved by the fan to pass through the heat exchanger. Air dams 1 allow air to flow more easily in one direction than the opposite direction. In the fan flow direction, air dams 1 provide relatively little resistance to the flow. In the direction opposite to fan flow direction, air dams 1 provide more resistance than as compared to the resistance when air flows in the fan flow direction. Under ram air conditions (e.g., when the vehicle is moving), the use of air dams can reduce the load on the fan's motor by cooling properties of ram air, while reducing recirculation, thereby increasing efficiency.

8 Claims, 12 Drawing Sheets

TYPICAL DAM/ECAD CONFIGURATION
A: RAM AIR CONDITIONS - FLOW LEFT TO RIGHT
B: RECIRCULATION CONDITIONS - FLOW RIGHT TO LEFT

RAM AIR CONDITIONS ON DAMS AT 1 kg/s

FLOW TRAVELS FROM LEFT TO RIGHT

A file : chk2dd_ram2
Mass Flow : 1 Kg/s
Inlet : -0.0400 Pa/m2
Outlet : -18.12 Pa/m2

RECIRCULATION AIR CONDITIONS ON OAMS AT 1 kg/s

FLOW TRAVELS FROM RIGHT TO LEFT

8 file : chk2dd_recirc2
Mass Flow : 1 Kg/s
Inlet :-0.0227 Pa/m2
Outlet : +31.445 Pa/m2

RAM AIR CONDITIONS ON DAMS AT 0.5 kg/s

FLOW TRAVELS FROM LEFT TO RIGHT

A file : chk2dd_ram3
Mass Flow : 0.5 Kg/s
Inlet : -0.041 Pa/m2
Outlet : -5.078 Pa/m2

RECIRCULATION AIR CONDITIONS ON DAMS AT 0.5 kg/s

FLOW TRAVELS FROM RIGHT TO LEFT

B file : chk2dd_recirc3
Mass Flow : 0.5 Kg/s
Inlet : -0.0893 Pa/m2
Outlet : 8.167 Pa/m2

COOLING MODULE WITH AIR DAMS

CROSS-REFERENCE TO RELATED APPLICATIONS

The present application claims priority from U.S. Provisional Patent Application No. 60/299,703, filed Jun. 20, 2001, entitled ENGINE COOLING AIR DIODE, which application is hereby incorporated by reference.

FIELD OF THE INVENTION

The invention generally relates to cooling modules having axial flow fan designs to cause airflow through a heat exchanger and, more particularly, to a vehicle engine cooling module which reduces electric motor energy draw requirements by minimizing energy needed to cause cooling airflow through the radiator.

BACKGROUND OF THE INVENTION

An axial flow fan may be used to produce a flow of cooling air through the heat exchanger components of a vehicle. For example, a an engine cooling module used in an automotive cooling application may include an electric motor driven axial flow fan for moving cooling air through a heat exchanger such as an engine radiator, condenser, intercooler, or combination thereof to cool the engine.

Operating the electric motor to drive the fan to cool the radiator undesirably consumes significant electrical energy and thus fuel when a vehicle is in operation. There is a need to reduce the energy draw of the electric motor of an engine cooling module and thus reduce the fuel consumed in operating a vehicle.

SUMMARY OF THE INVENTION

An object of the invention is to fulfill the need referred to above. In accordance with the principles of the present invention, this objective is achieved by providing an engine cooling module which includes a shroud, a heat exchanger coupled to the shroud, a fan, a motor for driving the fan, and a plurality of air dams. The shroud, circumscribing the fan, has a main opening to allow air to pass through the fan to or from the heat exchanger. A fan is associated with the shroud so as to be adjacent to the fan opening to permit air moved by the fan to pass through the heat exchanger. An electric motor drives the fan.

The air dams of the invention allow air to flow more easily in one direction than the opposite direction. In the fan flow direction, the air dams provide relatively little resistance to the flow. In the direction opposite to fan flow direction, the air dams provide more resistance than the resistance faced by air flowing in the fan flow direction. Under ram air conditions (e.g., when the vehicle is moving), the use of air dams can reduce the load on the fan's motor by enhancing flow through the radiator. The air dams of the invention reduce the recirculation of relatively warm air when the vehicle is at rest. Recirculation of relatively warm air reduces cooling module efficiency by causing the fan to re-pump hot air.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE PREFERRED EMBODIMENT

Figure 1:
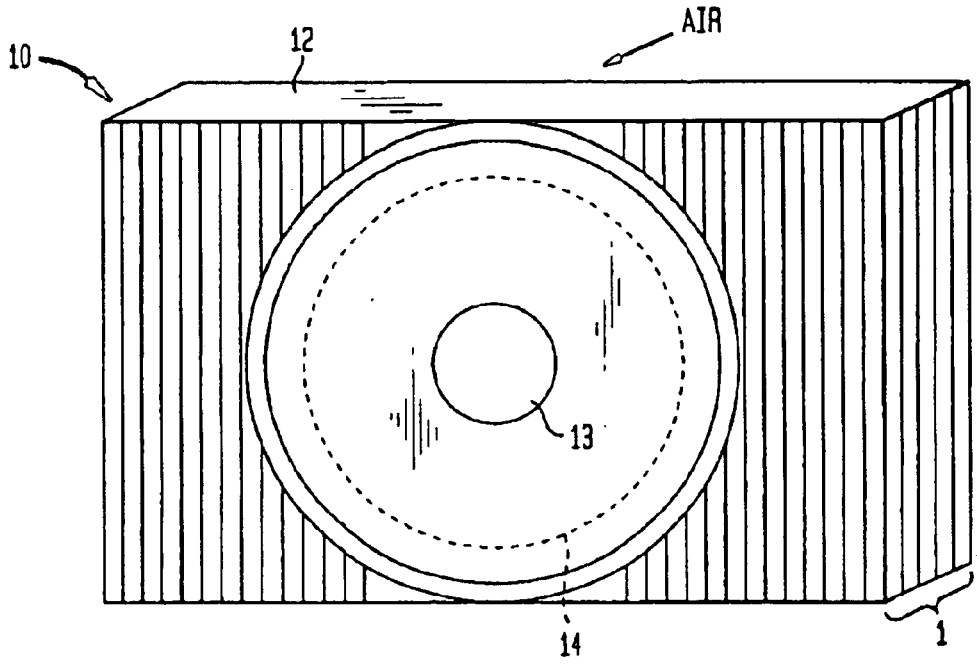
FIG. 1 is a schematic illustration of a cooling module provided in accordance with the principles of the invention.
Figure 2:
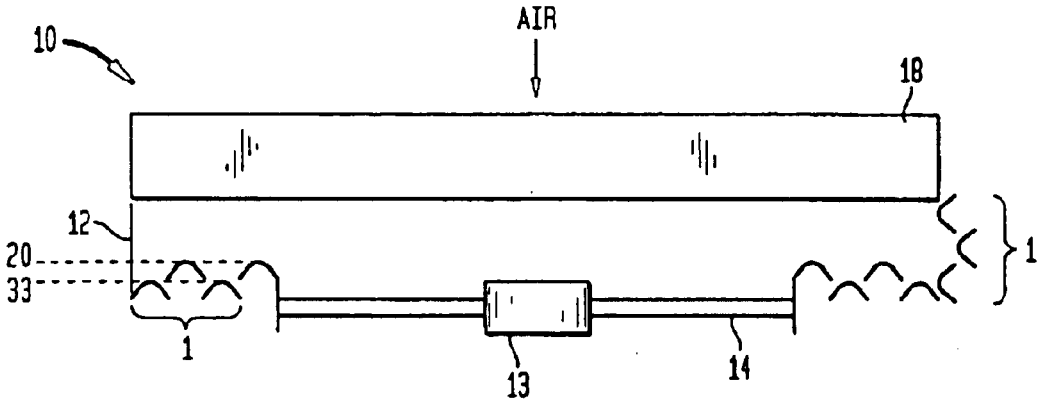
FIG. 2 is a top view of the cooling module shown in FIG. 1.
Figure 3:
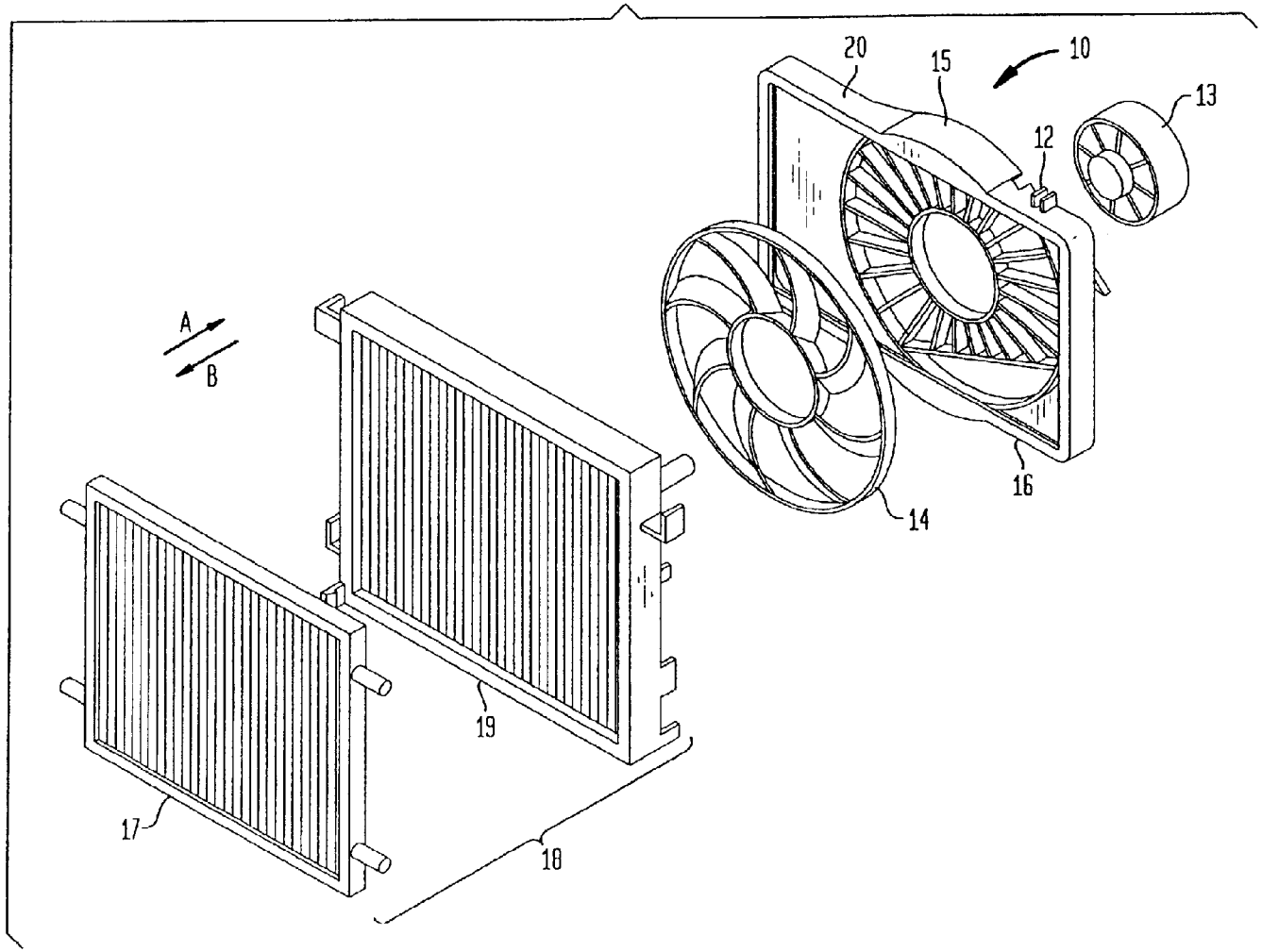
FIG. 3 is an exploded view of the cooling module shown in FIG. 1.

FIG. 1 is an isometric view, FIG. 2 is a top view, and FIG. 3 is an exploded view of the same cooling module of the invention. Those figures generally show a cooling module 10 in accordance with the principles of the present invention. Cooling module 10 includes a heat exchanger 18, a fan 14, which is associated with shroud 12 and driven by motor 13, and air dams 1. Heat exchanger 18 may comprise condenser coil 17 and radiator 19, as shown in FIG. 3.

As shown in FIG. 3, shroud 12 has a fan opening 15 in shroud wall 16 to permit air, moved by fan 14, to pass through shroud 12. Cooling module 10 is constructed and arranged to be disposed downstream or upstream of heat exchanger 18. While the figures herein show the heat exchanger to be upstream the fan flow direction (A) of the cooling module, the heat exchanger can also be downstream of the cooling module in accordance with the invention. When the heat exchanger is upstream of the cooling module, the fan pulls air through the heat exchanger, which is often called a puller configuration. Likewise, when the heat exchanger is downstream the cooling module, the fan pushes air through the heat exchanger, which is often called a pusher configuration.

Rotation of fan 14 causes a substantial quantity of air to flow generally along the axis in the direction shown by arrow A in FIG. 3. Flow direction A is in the fan downstream direction and in the direction of ram air, assuming there is ram air.

Ram air is air that flows, without the impetus of the rotation of fan 14, through heat exchanger 18. Ram air exists when the cooling module is in motion with respect to ambient air, such as when a vehicle is moving down the road. In FIG. 3 (air dams not shown), if ram air existed, it would flow generally in direction A. Flow direction B is in the fan upstream direction (e.g., in the direction of recirculating flow), which is the direction opposite to the direction of fan flow and ram air. Recirculation is generally hot air which moves from the engine compartment forward through the heat exchanger. Recirculation reduces cooling module efficiency by causing the fan to re-pump the same air. In addition, heat transfer capacity is reduced due to higher air temperature entering the heat exchanger.

A well-designed, efficient cooling module in accordance with the invention would provide relatively little flow resistance for air flowing in direction A and relatively higher flow resistance for flow in direction B. In such manner, the increase in ram air cooling would be greater than recirculation losses in efficiency. As described below, air dams reduce flow in direction B (e.g., reducing re-circulation depending on the orientation of air dams 1), increasing fan efficiency and lowering the load on the motor.

Under ram air conditions when the vehicle is moving, the use of air dams 1 reduces the load on fan motor 13 because it increases the effective opening area (allowing more air to flow through the fan in direction A), when compared to a solid shroud that completely encloses one side of the heat exchanger.

The air dams of the invention can be positioned in various configurations relative to heat exchanger 18, shroud 12 and fan 14, depending on design considerations. In the preferred embodiment (e.g., see FIGS. 1–3, especially FIG. 2), at least two, axially-staggered rows of air dams 1 are provided through wall 16 of shroud 12. Thus, a first row of air dams provided along a first axis 20 so as to define a space between adjacent air dams. A second row of air dams is disposed on a second axis 33 spaced from the first axis 20, with the flow deflecting surface 4 of each air dam of the second being oriented in the same direction as the flow deflecting surfaces of the first row of air dams. Furthermore, each flow deflecting surface 4 of the second row of air dams is disposed to generally obstruct the space between air dams. The two rows of air dams can rap around one (see FIG. 2) or both sides of the shroud.

In the embodiment shown in FIGS. 1–3, air dams 1 are placed around fan opening 15 to permit air to pass through shroud 12 in either axial flow direction A or B shown in FIG. 3. In such embodiment of the invention, air dams 1 can be a molded portion of shroud 12, made out of the same, relatively rigid material as shroud 12. When in this orientation (see FIGS. 1–3), air dams reduce flow in direction B (reducing recirculation of air flowing through the fan).

Figure 4:
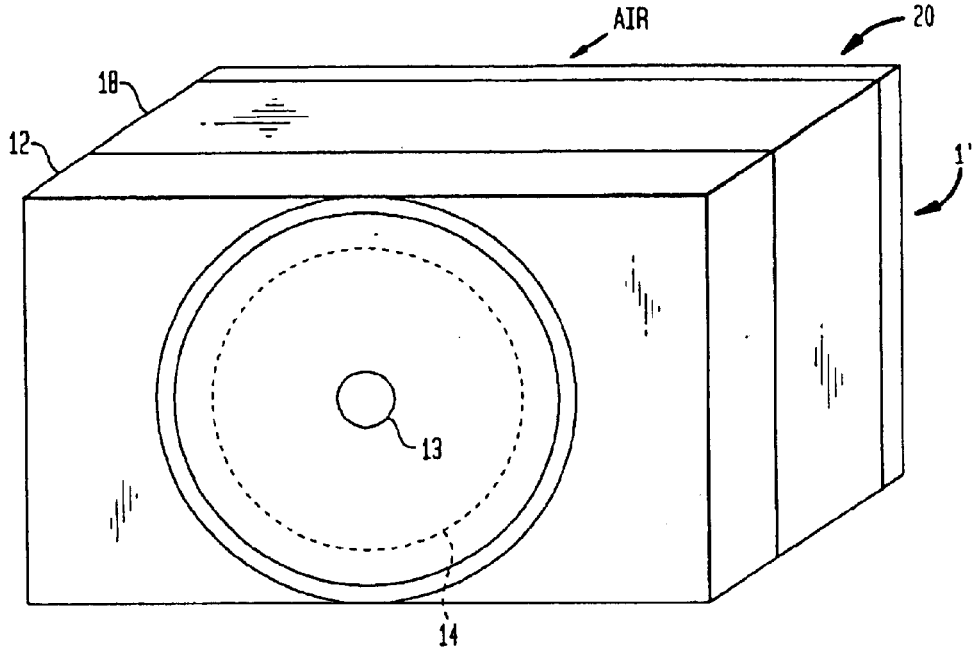
FIG. 4 is an embodiment of the invention where air dams are upstream of a heat exchanger.
Figure 5:
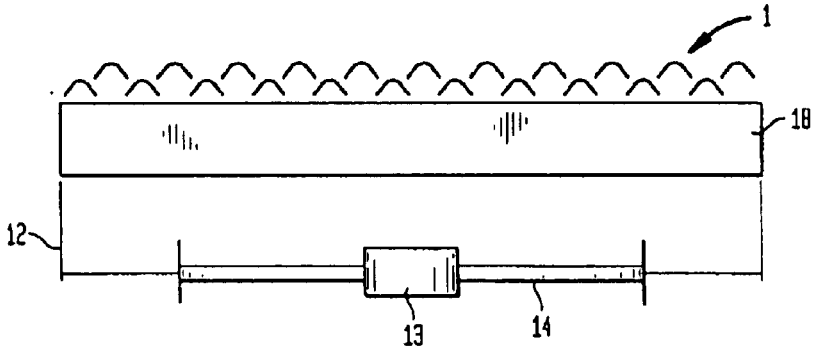
FIG. 5 is a top view of the cooling module in FIG. 4.
Figure 6:
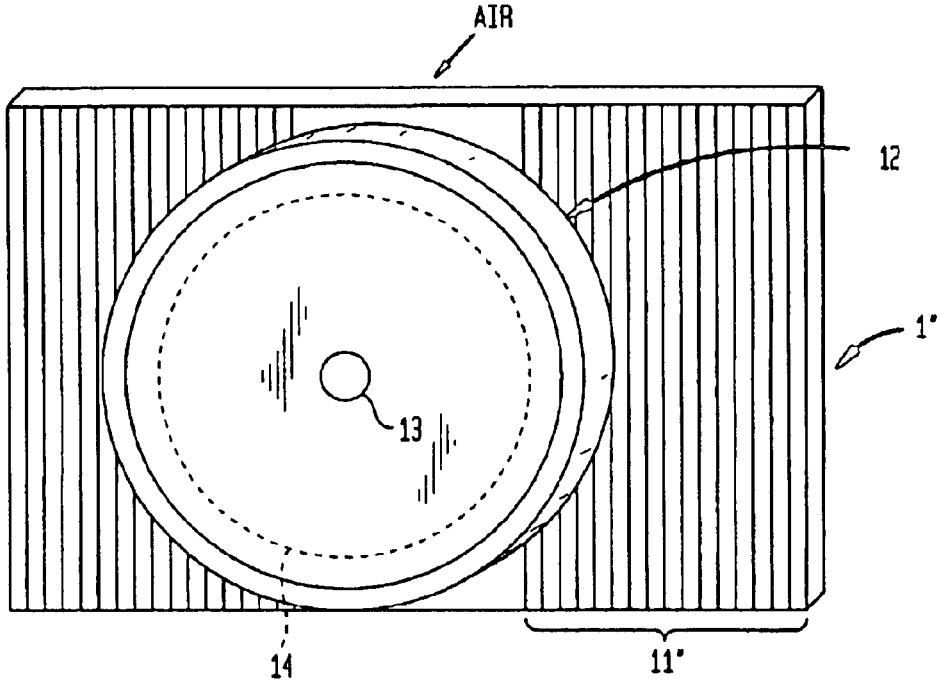
FIG. 6 is another embodiment of the invention.
Figure 7:
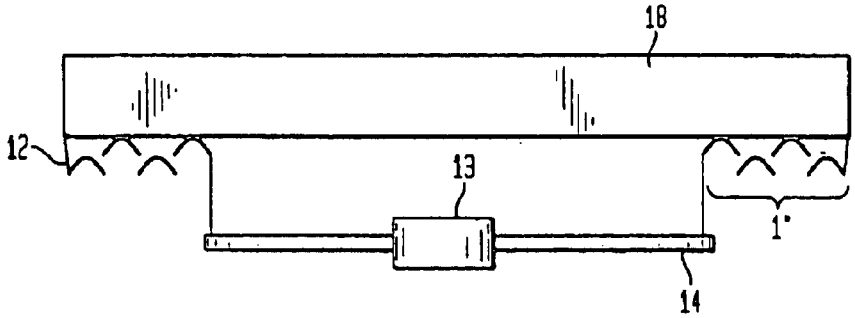
FIG. 7 is a top view of the invention in FIG. 6.

However, air dams 1 need not be contained within, or part of, shroud 12 as shown in FIGS. 1–3. For example, FIGS. 4–5 show another embodiment of the invention whereby air dams 1' are upstream heat exchanger 18, shroud 12 and fan 14. Another embodiment of the invention is shown in FIGS. 6–7, whereby air dams 1" are positioned downstream heat exchanger 18, but upstream shroud 12 and fan 14.

Figure 8:
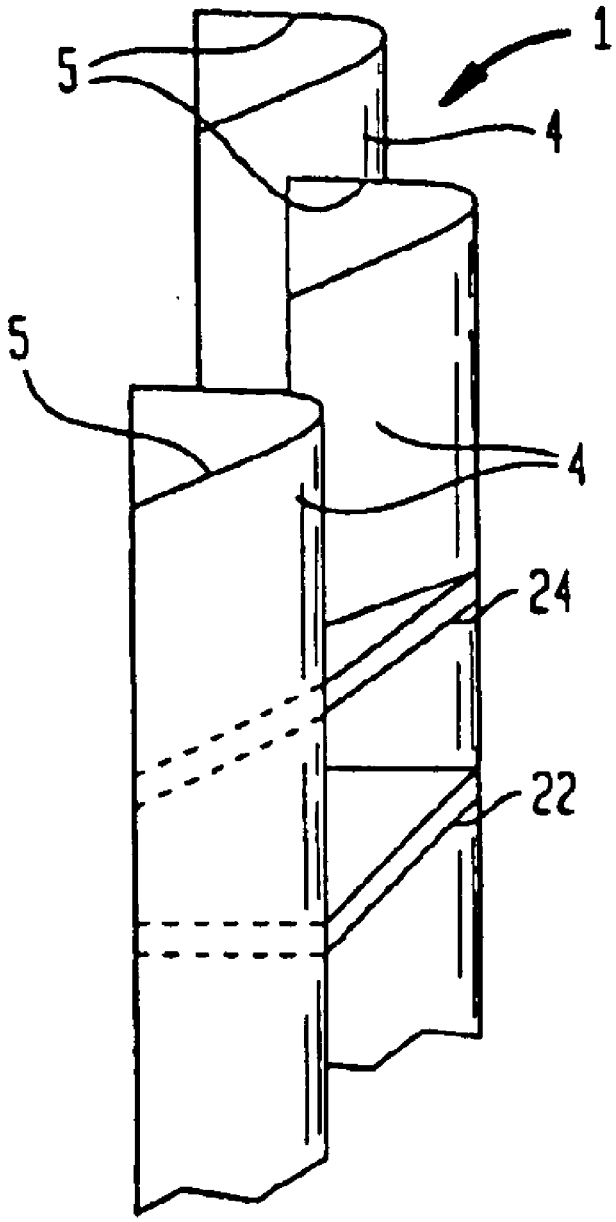
FIG. 8 shows support plates between air dams for directing air or minimizing drag.

The air dams 1 are shown to be generally cup-shaped, having a flow deflecting surface 4 and a flow impeding surface 5 opposite the flow deflecting surface, as shown in FIG. 8. Other shapes of air dams are contemplated in accordance with the invention, such as V-shaped, C-shaped, U-shaped. More generally, air dams 1 can be designed so that they are generally convex on their leading edges (i.e. when viewed in the direction downstream of airflow A) to facilitate flow in the fan flow axial direction A and generally concave on their trailing edges (i.e., when viewed in the direction upstream of airflow A) to hinder undesirable recirculation in direction B. In other words, when cooling air is flowing in fan flow direction A, air passes relatively easily by and around the convex side of air dams 1, which provide relatively little resistance to the flow in direction A. In the opposite direction, i.e., in direction B—air dams 1 provide more resistance than when air flows in fan flow direction A. The relationship between and positioning among air dams 1 also affects the flow. The spaces between the air dams in the leading or first row of dams creates a jet which influences air flow between the air dams causing the flow stream to be directed to the convex area of the second row of dams.

The air dams of the invention do not require motorized actuation to work. Air dams can be substantially fixed (relatively static) or partially flexible. In one embodiment described above, air dams 18 are a molded portion of shroud 12 and made out of the same relatively rigid material as shroud 12. However, air dams 1 can also be made from a material more or less flexible than the shroud material depending on the desired effect. For example, if the air dams is made from a partially flexible material, the favorable flow effects may be enhanced under certain operating conditions. This is because, when partially flexible air dams are exposed to ram air at sufficient flow rates, the air dams will deform and narrow (as if the convex surface of air dams were being pinched closed), thereby decreasing the resistance of air flowing in direction A. Conversely, when partially flexible air dams are exposed to a sufficient flow of air in direction B (e.g., recirculated air), the concave, back surface of air dams 1 will deform by widening (spreading out), adding further resistance to flow in direction B by narrowing the flow path around air dams 1. If relatively flexible material is used for the air dams, the air dams should be biased in a relatively open (spread out position), using for example a spring or elastic material, such that air dams will open (i.e., seal) when exposed to net air flow in direction B (e.g., net recirculation).

In a conventional cooling system, when the cooling module is moving relative to ambient air (e.g., when the vehicle is moving), air will pass through the front of the vehicle, the radiator, the fan, and the shroud's main opening. In the invention, depending on the embodiment of the invention used, the use of air dams lowers the resistance (e.g., pressure drop) faced by the ram air because the ram air will have an effectively larger area through which to pass than it would if the air dams were replaced with material that totally blocks ram airflow (beyond what can pass through the shroud's main opening). Because the resistance met by the ram air is lowered with the presence of the air dams, cooling is enhanced at a given motor power usage level.

FIG. 8 shows low profile support plates 22 and typical angled support plates 24 between air dams, that may be used with the invention to support, and prevent excessive deflection of, air dams and to direct air around air dams to minimize drag (resistance) associated with air dams.

Figure 9:
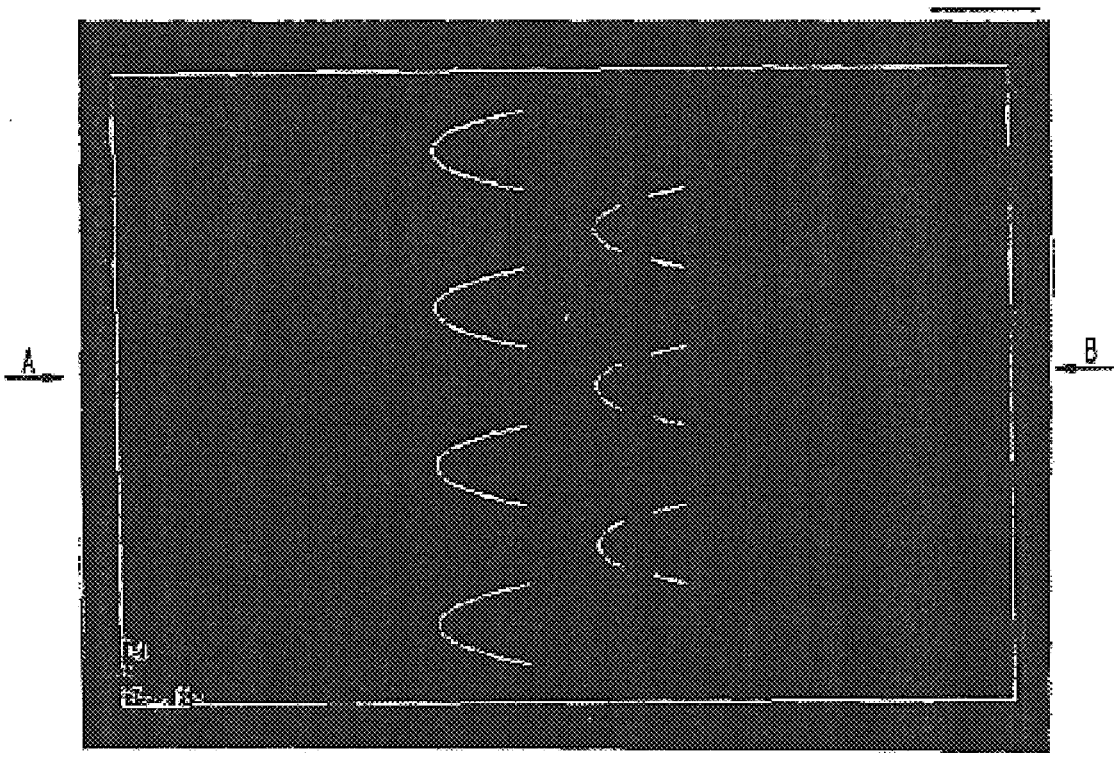
FIG. 9 is a top view of the invention showing a configuration of air dams.
Figure 10A:
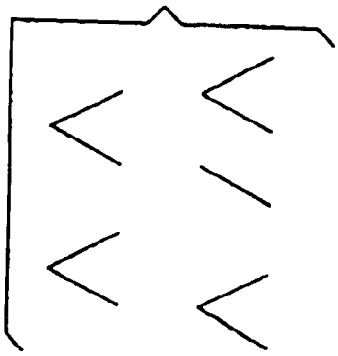
FIGS. 10(*a*)–10(*i*) show various configurations of air dams.
Figure 10B:
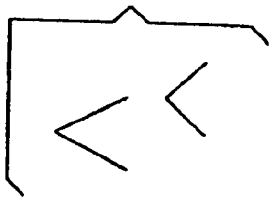
Figure 10C:
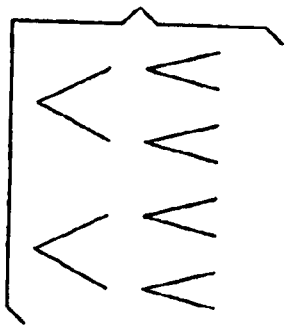
Figure 10D:
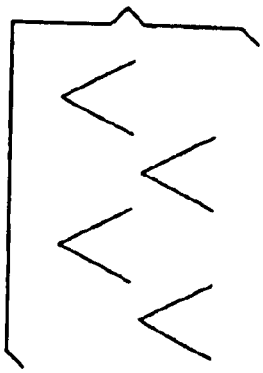
Figure 10E:
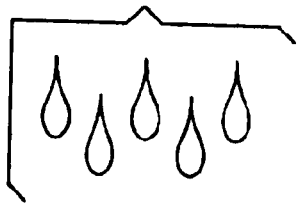
Figure 10F:
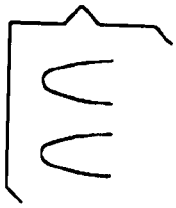
Figure 10G:
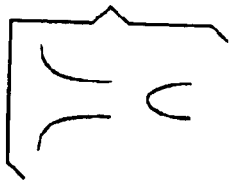
Figure 10H:
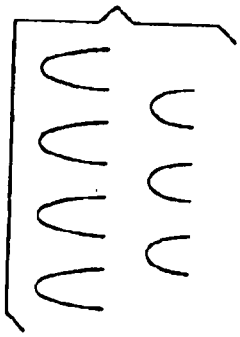
Figure 10I:
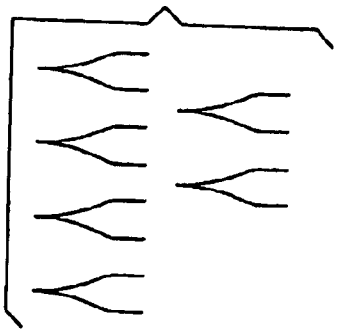
Figure 11A:
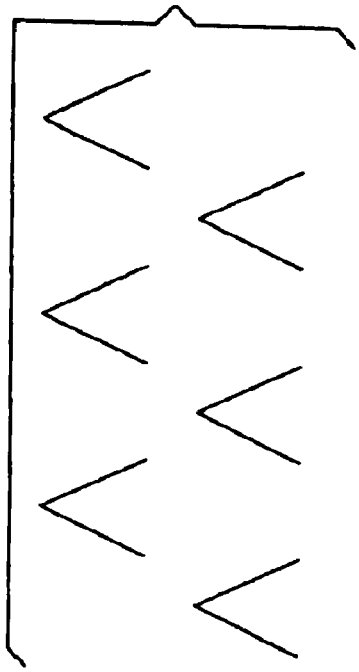
FIGS. 11(*a*)–11(*d*) show additional configurations of air dams.
Figure 11C:
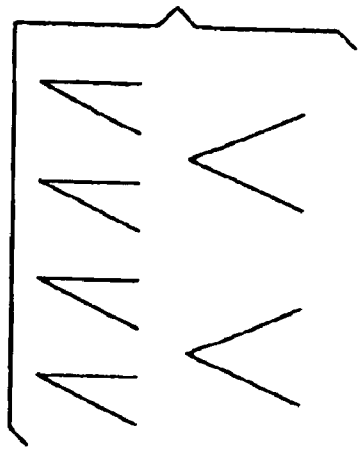
Figure 11B:
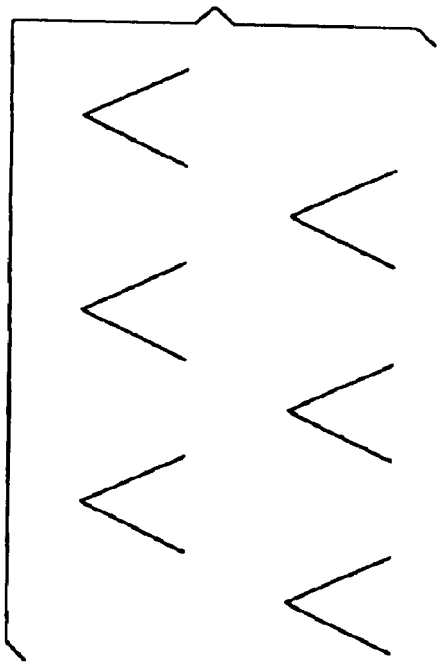
Figure 11D:
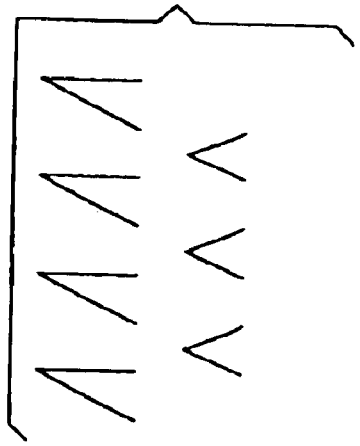

FIG. 9 is a top view of the invention showing a preferred configuration of air dams. Airflow direction A is shown flowing from left to right and airflow direction B is shown flowing from right to left. This configuration of air dams is easy to manufacture because a two-part mold can be used since the tip of one column of air dams does not overlap the second column of air dams. FIGS. 10(*a*)–10(*i*) and FIGS. 11(*a*)–11(*d*) show other air dam configurations.

FIGS. 12–15 show that the resistance (pressure drop between inlet and outlet) is greater when there is airflow in direction B as opposed to airflow in direction A, using the preferred embodiment of the invention shown in FIGS. 1–3.

FIGS. 12–15 also show the airflow patterns (shown by velocity vectors) about air dams in both airflow directions A and B at flow rates of 1 kilogram per second (kg/s) and 0.5 k/s. FIGS. 12–15 were developed using computational fluid dynamics flow modeling software called Fluent, which is manufactured by Fluent, Inc., headquartered in Centerra Park Lebanon, N.H.

Figure 12:
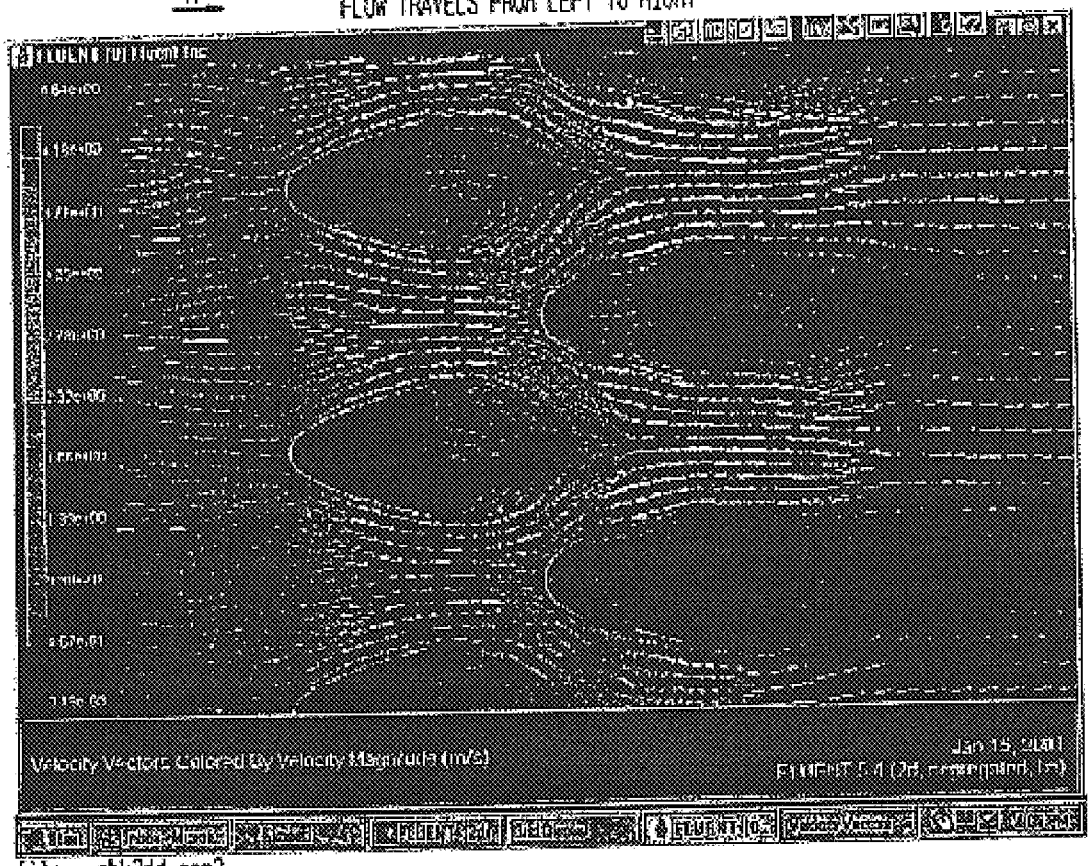
FIGS. 12–15 show airflow patterns, predicted by computational fluid dynamics, about air dams in airflow directions A and B at two different flow rates.
Figure 13:
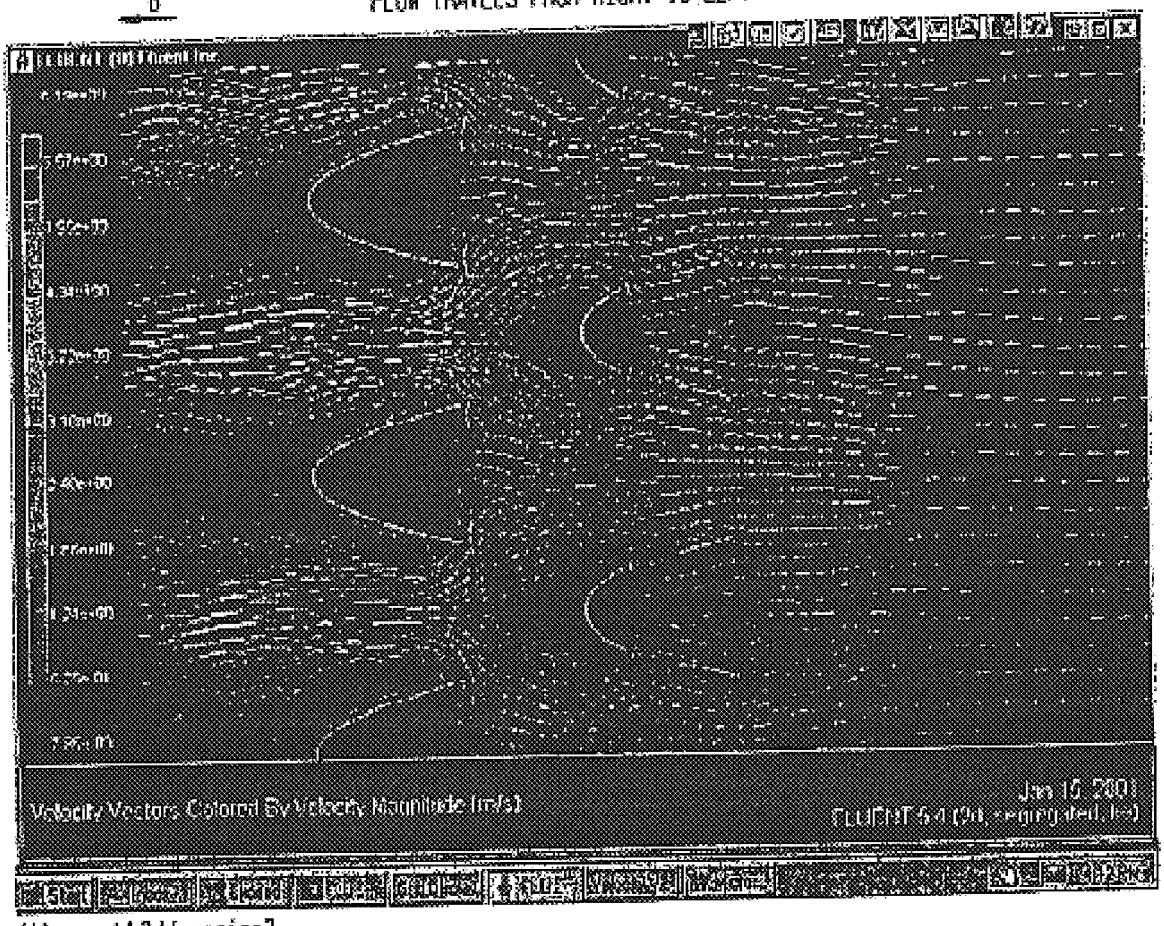
Figure 14:
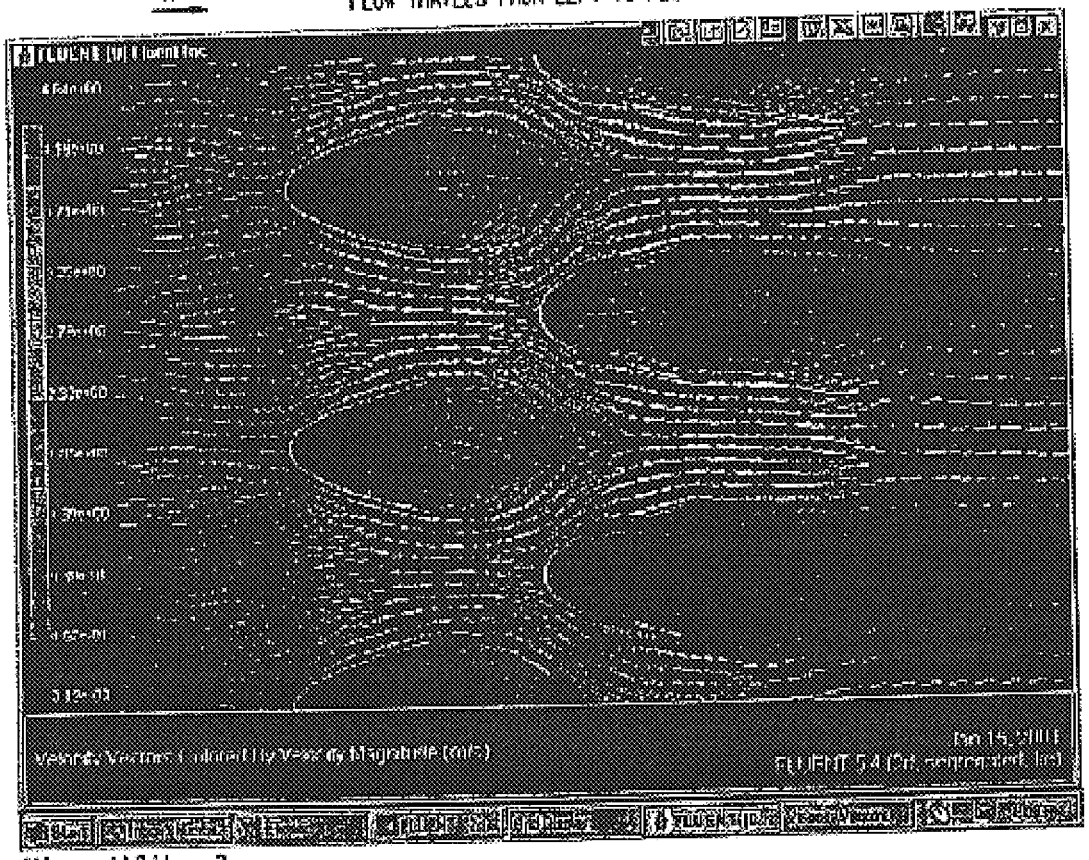
Figure 15:
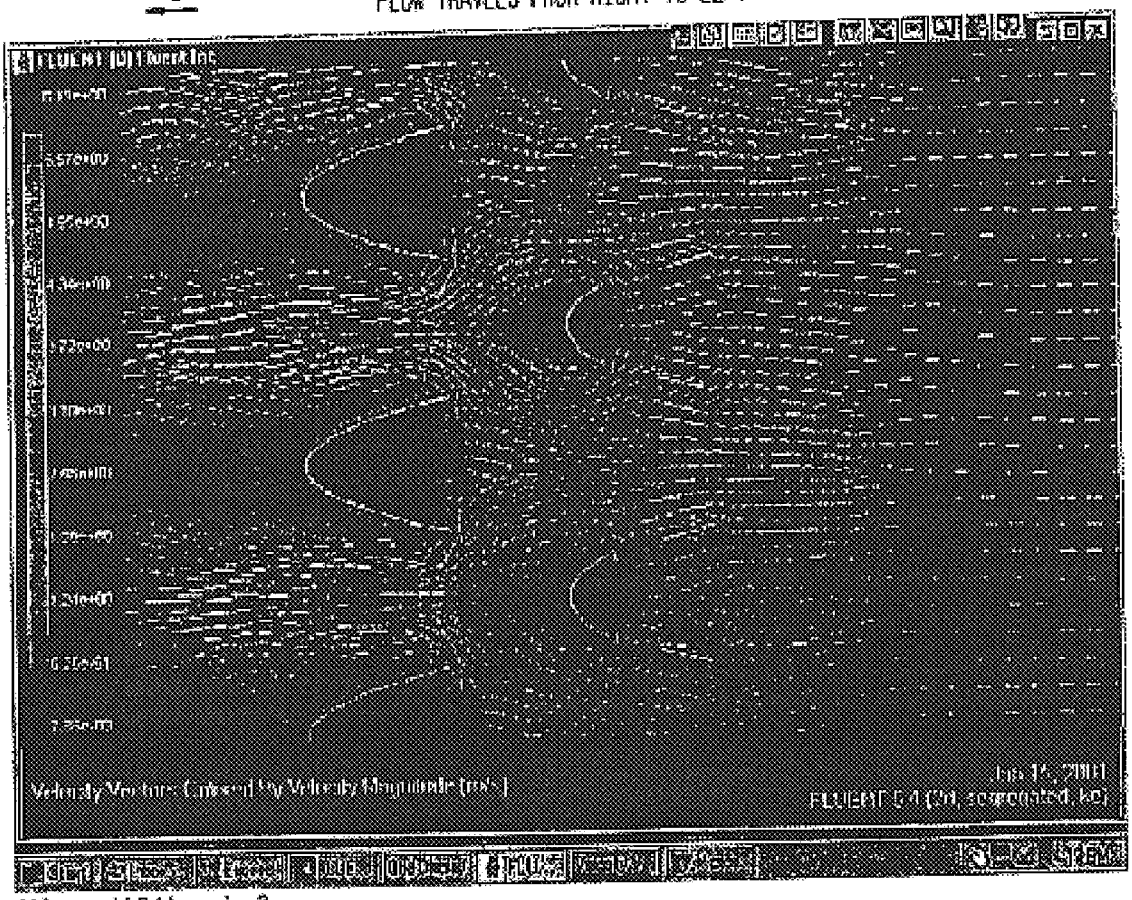

In FIG. 12, airflow (e.g., ram air) is flowing in direction A (from left to right) at a mass flowrate of 1 kg/s. The pressure drop caused by air dams is about 18 Pascals per square meter ($Pa/m^2$). When airflow is flowing in direction B (from right to left) at the same 1 kg/s flow rate, as shown in FIG. 13, the pressure drop through the air dams is about 31 $Pa/m^2$. Thus, air dams impede recirculation flow more than ram air flow. FIGS. 14 and 15 show that air dams also impede recirculation flow more than ram air flow, when the flow rates are lowered to 0.5 kg/s. Thus, the invention reduces recirculation while allowing the cooling benefits of ram air. The reduction in recirculation can lead to significant power savings.

The foregoing preferred embodiments have been shown to illustrate the principles of the invention and the methods of employing the preferred embodiments. This invention includes all modifications encompassed within the spirit of the following claims.

What is claimed is:

1. A cooling module comprising:

a shroud having at least one fan opening in a wall thereof to permit air to pass though the shroud;

a heat exchanger associated with the shroud;

at least one fan to permit air moved by the fan to pass through the heat exchanger in a certain direction;

a drive device to drive the fan; and a plurality of air dams constructed and arranged to allow air to flow more freely through the cooling module in the certain direction than in a direction opposite the certain direction, wherein the air dams are shaped to have a flow deflecting surface and a flow impeding surface opposite the flow deflecting surface, wherein the air dams are arranged in at least two-axially staggered rows with a first row of air dams provided along a first axis so as to define a space between adjacent air dams and, a second row of air dams is disposed on a second axis spaced from the first axis, with the flow deflecting surface of each air dam of the second row being oriented in the same direction as the flow deflecting surfaces of the first row of air dams and each flow deflecting surface of the second row of air dams being disposed to generally obstruct said space.

2. The cooling module of claim 1, wherein the air dams are integrally molded with the shroud.

3. The cooling module of claim 2, wherein the air dams are biased in a relatively open position.

4. The cooling module of claim 1, wherein the air dams are made of a semi-flexible material.

5. The cooling module of claim 1, wherein the plurality of air dams are disposed adjacent to the shroud.

6. The cooling module of claim 1, wherein the plurality of air dams are disposed adjacent to the heat exchanger.

7. The cooling module of claim 1, wherein the drive device is a motor.

8. The cooling module of claim 1, further comprising a support plate between an air dam of the first row and an air dam of the second row.

* * * * *